United States Patent [19]

Dibert

[11] 3,982,560

[45] Sept. 28, 1976

[54] VENTILATING APPARATUS FOR HEAT TRANSFER SYSTEMS

[76] Inventor: Fred Dibert, 2617 Prospect St., Flint, Mich. 48504

[22] Filed: May 13, 1974

[21] Appl. No.: 469,072

[52] U.S. Cl. ..... 137/527.8; 251/338

[51] Int. Cl.[2] ..... F16K 15/00

[58] Field of Search ..... 137/527.8; 251/338; 116/114 K

[56] References Cited

UNITED STATES PATENTS

| | | | |
|---|---|---|---|
| 987,946 | 3/1911 | Bergler | 137/527.8 X |
| 1,082,174 | 12/1913 | Rutherford | 251/338 X |
| 1,092,275 | 4/1914 | Long | 251/338 X |
| 1,162,239 | 11/1915 | Johnsgaard | 251/338 X |
| 2,431,827 | 12/1947 | Rado | 116/114 K X |
| 2,624,513 | 1/1953 | Field | 251/338 X |
| 2,652,200 | 9/1953 | Field | 251/338 X |
| 2,806,653 | 9/1957 | Ziph | 137/527.8 X |
| 2,840,317 | 6/1958 | Kozak | 137/527.8 X |

*Primary Examiner*—William R. Cline

[57] ABSTRACT

Apparatus for introducing fresh, outside air to a forced air heating or cooling system of buildings comprising a conduit for conducting fresh air to the system, a damper movably mounted in the conduit for adjusting the flow of fresh air therein, and a counterweight adjustably mounted on the damper inside the conduit for movement to selected counterbalancing positions.

7 Claims, 5 Drawing Figures

FIG. 1
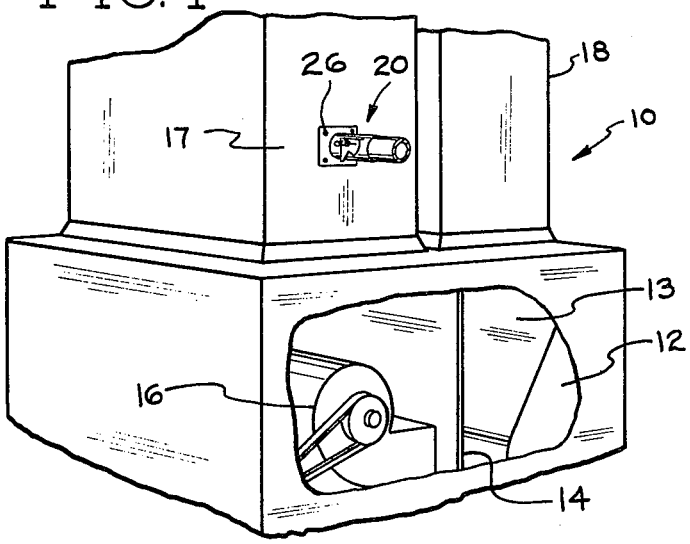
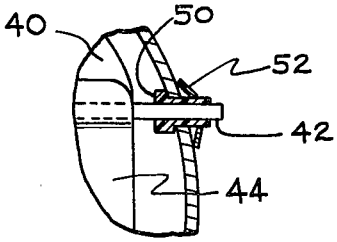
FIG. 5
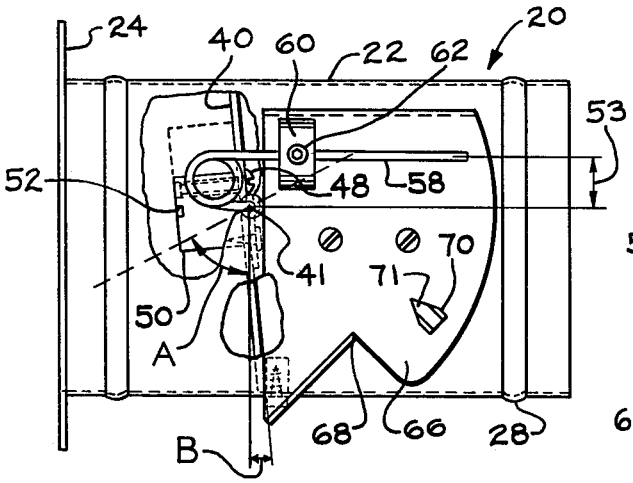
FIG. 3
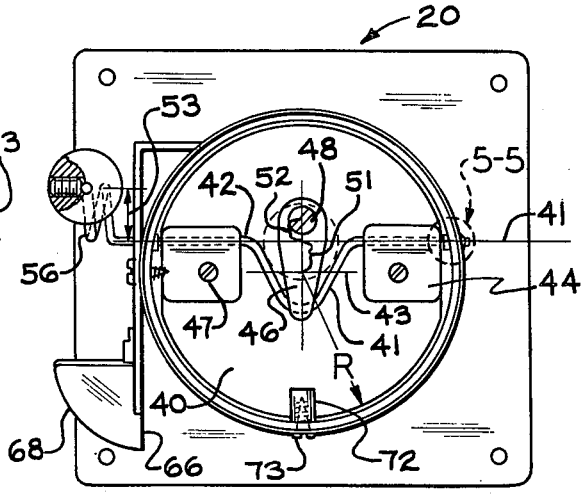
FIG. 4
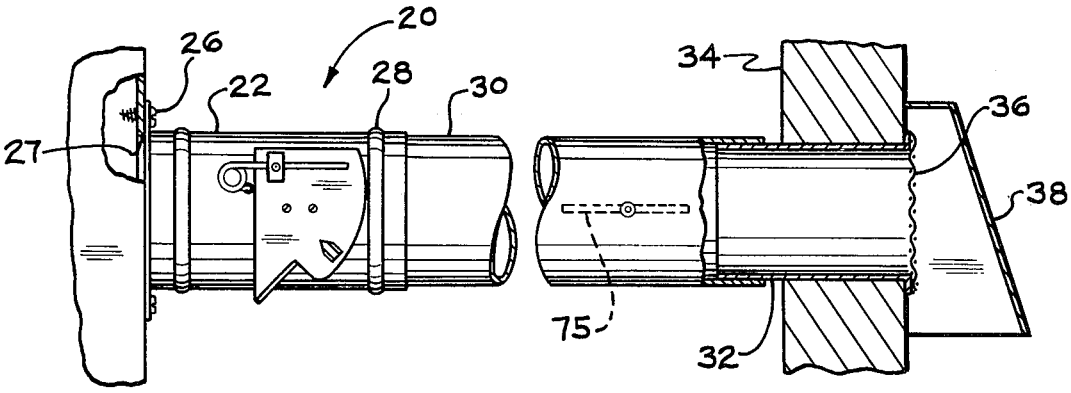
FIG. 2

VENTILATING APPARATUS FOR HEAT TRANSFER SYSTEMS

BACKGROUND OF THE INVENTION

This invention relates to a forced air heat transfer system of the type that circulates air throughout a building via ductwork that conducts the air around a heat exchanger to heat or cool the air. More particularly, the invention relates to a damper assembly for introducing fresh, outside air to the heat transfer system.

Recent research indicates that conventional forced air heating or air conditioning systems adversely affect the ion balance within the enclosure heated or cooled. Preferably, the negative and positive ions within the enclosure should be balanced, but the ductwork by means of which the heating or cooling air is distributed, as well as the incorporation of electronic air cleaning devices, results in a deficiency of negative ions and an overabundance of positive ions, or a deficiency in both kinds of ions. The use of synthetic, plastics materials within the enclosure also contributes to the ion imbalance or deficiency. Such an ion imbalance or deficiency has many disadvantageous effects, particularly on the health of the occupants of the enclosure. It has been demonstrated that the ion imbalance can be overcome, to a large extent, by the addition of fresh air to the heat exchanger of both heating and air conditioning systems. For further details on such research reference is made to Volumes I and II of *Proceedings of International Conference on Ionization of the Air*, Oct. 16 – 17, 1961, published by Franklin Institute, Philadelphia, Pennsylvania.

Apparatus for introducing fresh air to a heating system for a building are disclosed in U.S. Pat. Nos. 2,962,218, 2,009,643 and 3,204,870. Such apparatus includes a fresh air conduit in communication with outside fresh air and a damper or baffle plate swingably mounted in the conduit for adjusting the flow of air through the conduit. Although the conduits in which damper assemblies of this type normally are substantially horizontal, it is sometimes desirable due to limited space, for example, to mount such conduit vertically. To minimize the inventory and to minimize manufacturing and assembly costs, it is desirable to provide a damper assembly which can be mounted in either a vertical or horizontal conduit. Accordingly, it is an object of the present invention to provide a damper assembly of the type described including an air intake conduit which can be mounted in any selected one of a plurality of vertically or horizontally disposed positions.

A damper assembly constructed according to the present invention incorporates a counterbalance which is mounted on a damper or baffle plate that is movably mounted internally of a conduit for conducting fresh air to the heating system. The counterbalance is adjustably mounted on the baffle plate for movement to selected positions depending on the orientation of the conduit. The apparatus includes another adjustably mounted counterbalance connected to the damper or baffle plate but disposed exteriorly of the conduit for calibrating the counterbalancing system after installation of the damper assembly on the furnace. Accordingly, it is another object of the present invention to provide apparatus of the type described including a counterbalance mounted on the damper internally of the conduit and another counterbalance adjustably mounted exteriorly of the conduit to permit calibration of the counterbalancing system after installation.

Still another object of the present invention is to provide apparatus of the type described including a counterbalance which is adjustably mounted on the damper so as always to urge the damper to a conduit closing position regardless of the horizontal or vertical orientation of the fresh air conduit.

A still further object of the present invention is to provide apparatus of the type described including gauging means removably attached to the outside of the conduit for indicating the condition of filters or the like with which the furnace customarily is equipped.

Other objects and advantages of the present invention will become apparent to those of ordinary skill in the art as the description thereof proceeds.

SUMMARY OF THE INVENTION

Apparatus for introducing fresh air to a forced air, ducted heat transfer system which distributes air throughout a building comprising a conduit which may be either vertically or horizontally oriented, for conducting fresh air from outside of a building to the heat transfer system, a damper movable within the conduit to control the flow of fresh air therethrough, and a counterweight adjustably mounted on the damper for movement to selected positions dependent on the orientation of the conduit.

The present invention may more readily be understood by reference to the accompanying drawings, in which:

FIG. 1 is a perspective view of a typical heating system incorporating apparatus constructed according to the present invention;

FIG. 2 is an enlarged, partly sectional, side elevational view illustrating ventilating apparatus constructed according to the present invention and illustrating its association with the furnace and the exterior wall of a building;

FIG. 3 is a still further enlarged, side elevational view of the ventilating apparatus, parts being broken away to illustrate more clearly the components inside the conduit;

FIG. 4 is an end view of the apparatus illustrated in FIG. 3; and

FIG. 5 is a still further enlarged view of the apparatus encircled in the chain line 5-5 of FIG. 4.

DESCRIPTION OF THE PREFERRED EMBODIMENT

Apparatus constructed in accordance with the present invention is adapted for use in conjunction with a forced air heat transfer system which typically comprises a furnace, generally designated 10, that may be either gas or oil fired. The furnace 10 includes a hot air chamber 12 in which is mounted a heat exchanger 13, the hot air chamber being separated by a partition 14 from a cold air chamber 15 in which is mounted a conventional, motor driven, intermittently operated blower 16. Communicating with the cold air compartment 15 is a cold air return duct 17 through which cool air from inside a building is drawn by the blower 16 for delivery to the hot air compartment 12 via an opening formed in the partition 14 at the discharge end of the blower 16. In communication with the hot air compartment 12 is a hot air outlet duct 18 through which air warmed by the heat exchanger 13 is forced by the blower 16 for discharge to various rooms of the building, as is conventional. It should be understood, of course, that the heat exchanger 13 could comprise air cooling apparatus for cooling the air passing from the return duct 17 to the outlet duct 18.

Apparatus constructed according to the present invention comprises a damper assembly, generally designated 20, including a cylindrical conduit 22 of generally circular cross-section terminating at one end in a laterally extending, perimetrical mounting flange 24 for mounting the assembly on the cold air return duct 17 via screws 26 as illustrated in FIG. 2. An opening 27 may be formed in the cold air return duct 17 of such size as to correspond substantially to the cross-sectional area of the cylindrical conduit 22. The opposite ends of the conduit 22 are crimped or rolled as at 28 for strength. The free end of the conduit receives one end of a pipe 30, the opposite end of which receives a pipe 32 passing through a building wall 34 for communicating with the outside atmosphere. The outer end of the pipe 32 is covered by suitable screening material 36 and is shielded by a hood 38 to inhibit moisture and gusts of wind entering the fresh air conduit 30, 32.

Disposed within the conduit 22 is a rockable damper or baffle plate 40 which is mounted on a rotatable shaft 42 via clamping plates 44 that are secured to the damper plate 40 via screws 47 and 48, respectively. The shaft 42 also includes an offset portion 41 which is fixed to the damper by the plate 46. The shaft 42 is journaled in nylon bushings 50 that are received in openings formed in the side walls of the fresh air conduit 22, as particularly illustrated in FIG. 5, for rotation about an axis 41. Lock washers 52 fix the bushings in place. The damper plate 40 is generally of cylindrical configuration conforming generally to the internal configuration of the conduit 22 but having sufficient clearance to be easily rotated between the conduit closing position, illustrated in FIG. 3 in which it substantially prevents the flow of fresh air through the conduit 22, and the conduit opening position, illustrated in chain lines in FIG. 3 in which fresh air is permitted to flow to the cold air inlet duct 17.

The upstream side of the damper plate 40 is secured to the rockable damper shaft 42 adjacent the upper end of the damper plate 40 so that the damper plate 40 is eccentrically mounted and the force of gravity acts on the plate to urge it to move from the open position toward the closed position illustrated in FIG. 3 when the conduit 22 is horizontally oriented as illustrated in the drawings. When the conduit 22 is vertically oriented with the mounting flange 24 lowermost, the force of gravity acts on the plate to urge it to move toward the open position.

Eccentrically and adjustably mounted on the downstream side of the damper plate 40 is a counterweight 50 which is positioned as illustrated in solid lines in FIG. 3 when the conduit 22 is horizontally disposed so as to aid the force of gravity exerted on the damper plate 40 due to its eccentric mounting in urging the damper plate 40 from the open position to the closed position. The counterweight 50 can be adjusted to the position illustrated in chain lines in FIG. 3 when the conduit 22 is vertically disposed so as to counteract the force of gravity urging the damper plate 40 to the open position. An indicator slot 52 in the counterweight 50 provides the user with a quick visual indication of the orientation and position of the counterweight 50. In the position of the counterweight 50 illustrated in FIG. 3 the center of mass of the weight 50 is below the axis 41 of shaft 42 whereas in the position of the counterweight illustrated in chain lines in FIG. 3 it is above the axis 41. When the conduit 22 is mounted vertically, with the flange 24 lowermost, the eccentric mounting of the plate on the shaft 42 will cause the force of gravity to tend to swing the plate 40 to the open position. The counterweight 50 being disposed on the opposite side of the axis of rotation 41, will counterbalance the effect of gravity and tend to urge the baffle plate 40 to the closed position. Thus, in either adjusted position, the counterweight 50 will urge the baffle plate 40 to the closed position.

One end of the mounting shaft 42 is integrally joined to a convolute or spring-loop section 56 terminating in a rectilinear support rod 58. An external counterbalance 60 is adjustable along the length of the rod 58 and may be fixed in place by a set screw 62 in any one of a number of positions. When the conduit 22 is horizontally oriented, as illustrated in FIG. 3, the counterweight 50 and the counterbalance 60 are on opposite sides of the axis 41. The function of the counterbalance 60 is to provide a fine adjustment of the counterbalancing system after the damper assembly is installed. After installation the counterweight 50 is inaccessible and adjustment of the counterbalancing system must be effected through movement of the counterbalance 60 along the rod 58.

If the conduit 22 is horizontally oriented, the counterbalance 60 will be so positioned along the rod 58 as to overcome partially the gravitational forces acting on the damper plate 40, but the net force exerted by the counterbalance 60 should be less than the net force exerted by gravity on the plate 40 and counterweight 50 whereby the damper plate 50 is constantly urged toward the position in which it substantially closes the conduit 22. When the conduit 22 is vertically disposed, and the internal counterweight 50 is moved to the position illustrated in chain lines, the external counterbalance 60 is adjusted to a position in which, when the baffle 40 is open, the counterbalance 60 partially overcomes the force of counterweight 50 tending to close the baffle plate 40 and aids the gravitational force acting on the damper plate tending to open the plate. The external counterbalance 60 should be so positioned as to permit the counterbalance 60 to be disposed at a position on the same side of the axis of rotation 41 as the major portion of the damper plate 40 extends. The net gravitational force exerted on the external counterbalance 60 and the major portion of the damper plate tending to maintain the plate open should be less than the net gravitational force exerted on the counterweight 50 and the minor portion of the plate tending to maintain it closed.

A stop plate 66 is externally mounted on the side of the conduit 22 and includes a stop tab or projection 68 which is engaged by the counterbalance mounting rod 58 to interrupt the swinging movement of the damper plate 40 when the damper plate has swung to a position in which it is inclined at an angle A of 70° to a plane passing through the rotational axis 41. A marker, generally designated 70, is removably attached to the stop plate 66 via a magnet 71 and is movable to a position aligned with the rod 58 to indicate the internal position of the damper plate 40 when it is open. Air filters (not shown) may suitably be provided in the cold air return duct 17 and the conduit 22. When the filter system in the furnace 12 becomes clogged with dirt, the arm 58 will not swing to a position aligned with the marker 70, providing an indication to the user that the filter should be changed.

A resilient stop 72, constructed of rubber or other suitable material, is disposed on the inside bottom wall of the conduit 22 via a screw 73 for interrupting swinging movement of the plate 40 when the plate 40 is inclined at an angle B or 2° to 5° to a vertical plane passing through the axis 41. It is important that the plate be slightly vertically inclined in the closed position so that incoming gusts of draft air impinging on the lower portion of plate 40 will be at least partially deflected upwardly to increase the pressure at the upper end of the tube 22. This tends to prevent inadvertent opening or rocking of the damper plate under the influence of gusts of wind so as to prevent the damper from making objectionable noises.

It has been found that the damper assembly constructed according to the following dimensions is particularly effective in preventing the damper plate 40 from opening if air has not been removed from the house and the blower 16 is not operating but then immediately recovering to provide make-up air as necessary. Assuming that the baffle plate 40 has a longitudinal axis 43 and a radius R, the transverse rotational axis 41 is located a distance 51 equal to 0.28 R above the axis 43. The axis of the locating screw 48 mounting the counterweight 50 is located at a distance 52 equal to 0.39 R above the axis 43. The counterweight 50 for a 6 inch diameter damper plate 40 may be formed of steel and have a one inch outside diameter and be 1.375 inches in length. The distance 53 between the longitudinal axis of the support rod 58 and the axis 43 is 0.58 R.

The coil spring loop section 56 damps movement of the damper plate 40 from the closed position to the open position without imparting large shock loads to the rotational shaft bearings 50. The coil spring loop section 56 further permits a substantial mass 60 to be disposed on the support rod 58 which stabilizes the damper against drafts from being moved by outside wind gusts when the pipe is vertically disposed. An additional air shut-off valve 75 (FIG. 2) may be mounted in the pipe 30 to close the conduit 30 when the system is to be rendered inoperative for a lengthy period.

The apparatus is conditioned for operation by cutting an opening 27 in the wall of the cold air return duct 70. It will be assumed that the damper assembly is horizontally oriented with the flange 24 mounted on the wall via screws 26 as illustrated in FIGS. 1 and 2. An opening is cut in the building wall 34 for the reception of the tube 32. The conduits 32 and 22 are joined by a pipe 30 to permit outside air to flow to the inlet duct 17 via the screen 36 and the conduits 32, 30 and 22. The blower 16 is generally operated intermittently to draw air from within the building via duct 17 and discharge it past the heat exchanger 13 into the duct 18. The blower will intermittently operate, in response to operation of a thermostat, a sufficient length of time to maintain the temperature in the building substantially constant. When the blower 16 is operated, the air in the conduit 22 at the downstream side of the damper plate 44 is partially evacuated by the blower 16 to create a differential pressure across the plate 40. The pressure differential will cause the damper plate 40 to swing from its conduit closing position to its open position illustrated in chain line, thereby enabling fresh air to be drawn into the cold air return duct 17 via the pipes 30, 32.

The fresh air delivered to the duct 17 will be mixed with air passing therethrough and partially warmed by the air in the duct that was withdrawn from the rooms of the building. All of such air will be circulated around the heat transfer apparatus 13 to be heated by the latter prior to its discharge through the discharge duct 18. When the damper plate 40 opens, the pressure tends to equalize somewhat but the air being drawn into the conduit 22, as well as the counterbalance 60 tends to hold it open. When the operation of blower 16 is interrupted, the pressure on the upstream and downstream sides of the baffle plate 40 will be equalized and the gravitational force exerted on the damper and the counterweight 50 will swing the damper plate 40 to the closed position thereby disabling air from passing through the conduit 22.

The disclosed embodiments are representative of the presently preferred forms of the invention, but is intended to be illustrative rather than definitive thereof. The invention is defined in the claims.

What is claimed is:

1. Apparatus for introducing fresh air to a forced air heating system comprising a fresh air conduit having a longitudinal axis, said conduit being open at both of its ends and adapted to occupy any one of a number of selected positions between vertical and horizontal; damper means; eccentric means mounting said damper means in said conduit for rocking movements about a rotary axis between conduit closed and conduit open positions, the eccentricity of said mounting means causing said damper means normally to seek a vertical position due to the force of gravity regardless of whether said conduit occupies a horizontal or vertical position; adjustable counterweight means of such mass as to be capable of overcoming the force of gravity acting on said damper means; means mounting said counterweight means on said damper means for movements of said counterweight means relative to said rotary axis to a selected one of a number of positions on opposite sides of said rotary axis and in any selected one of which positions said counterweight means exerts a force on said damper means to urge the latter in a direction toward its conduit closed position; and stop means responsive to movement of said damper means to its conduit closed position to prevent further movement of said damper means in said direction.

2. Apparatus according to claim 1 including counterbalance means connected to said damper means externally of said conduit means, said counterbalance means opposing in part the force of said counterweight means.

3. Apparatus according to claim 1 wherein the mounting means for said counterweight means enables movement of the latter radially of said rotary axis.

4. Apparatus according to claim 1 wherein said rotary axis is offset to one side of the longitudinal axis of said conduit.

5. Apparatus according to claim 4 wherein said stop means occupies the position on the opposite side of the longitudinal axis of said conduit.

6. Apparatus according to claim 1 including an arm member connected to said damper means for movement therewith and extending externally of said conduit; and reference means carried by said conduit adjacent said arm member and operable to indicate the extent of movement of said damper means from its conduit closed position toward its conduit open position.

7. Apparatus according to claim 6 wherein said reference means is adjustable relatively to said conduit.

* * * * *